US007818895B2

(12) United States Patent
Boone et al.

(10) Patent No.: US 7,818,895 B2
(45) Date of Patent: Oct. 26, 2010

(54) SHOE FOR PROFESSIONAL TRUCKERS

(75) Inventors: Mary Boone, Pittsburgh, PA (US); Kajal Gala, New York, NY (US); Jules Henry, Dunbar, WV (US); JoongHo Hwang, Seoul (KR); Prakash Somasundaram, Pittsburgh, PA (US)

(73) Assignee: International Truck Intellectual Property Company, LLC, Warrenville, IL (US)

( * ) Notice: Subject to any disclaimer, the term of this patent is extended or adjusted under 35 U.S.C. 154(b) by 725 days.

(21) Appl. No.: 11/751,110

(22) Filed: May 21, 2007

(65) Prior Publication Data

US 2008/0209770 A1 Sep. 4, 2008

Related U.S. Application Data

(60) Provisional application No. 60/803,043, filed on May 24, 2006.

(51) Int. Cl.
*A43B 7/06* (2006.01)

(52) U.S. Cl. ..... 36/3 R; 36/3 A; 36/3 B

(58) Field of Classification Search ..... 36/3 R, 36/3 A, 3 B, 29

See application file for complete search history.

(56) References Cited

U.S. PATENT DOCUMENTS

| | | | | |
|---|---|---|---|---|
| 1,394,348 | A * | 10/1921 | Pietrowski | 36/3 A |
| 1,797,309 | A * | 3/1931 | Wojciechowski | 36/3 A |
| 5,953,835 | A | 9/1999 | Kwon | |
| 5,996,250 | A | 12/1999 | Reed et al. | |
| 6,115,940 | A * | 9/2000 | Chen | 36/4 |
| 6,463,679 | B1 | 10/2002 | Buttigieg | |
| 7,200,957 | B2 * | 4/2007 | Hubbard et al. | 36/50.1 |
| 2005/0178023 | A1 * | 8/2005 | Hammonds | 36/3 B |

* cited by examiner

*Primary Examiner*—Ted Kavanaugh
(74) *Attorney, Agent, or Firm*—Jeffrey P. Calfa; Mark C. Bach

(57) ABSTRACT

A shoe (10) created with the professional truck driver in mind has a lower assembly (12) and an upper assembly (14) that provide an interior for a person's foot and a foot opening through which a person's foot can be inserted into and removed from the shoe interior. The shoe features an air exhaust system (22), a toe cover (24) having an air vent (68, 70, 72) that can be opened and closed, a mesh band (84) in the portion of the upper around the ankle, and a hook-type clasp system (94, 96) for a strap (92).

9 Claims, 4 Drawing Sheets

SHOE FOR PROFESSIONAL TRUCKERS

REFERENCE TO RELATED APPLICATION AND PRIORITY CLAIM

This application claims the priority of Provisional Patent Application No. 60/803,043, filed on 24 May 2006, the entire content of which is incorporated herein by reference.

FIELD OF THE INVENTION

This invention relates to a shoe that has been created by the team of inventors to serve particular needs of professional truckers.

BACKGROUND OF THE INVENTION

Significant mental and physical demands can at times be imposed on a professional truck driver due to long hours of driving and extended time away from home. The task of driving a large truck hauling a heavy load in varied geographical regions under various weather and road conditions tends to limit the opportunity for the driver to engage in simple physical activities while driving, such as merely standing up to stretch, much less walking. A driver typically remains basically sedentary for a number of hours while having to pay attention to road and traffic conditions.

Truckers realize that the largely sedentary nature of such a lifestyle may not be conducive to staying in top physical condition, but for whatever reason or reasons, may not engage in healthy activities when they have the time and/or opportunity to do so.

Access to services and products that might promote good physical and mental well-being are often limited or unavailable while a trucker is on the road. For example, food choices at truck stops may be limited, and "fast food" meals may become a staple of a trucker's diet while on the road.

While truckers may experience fatigue and lower body discomfort after being behind the wheel for an extended time, they may not purchase products or services that could potentially alleviate those conditions because they may perceive little or no value in them. Recognizing this seemingly low motivation on the part of significant portion of the professional truck driver population to seek solutions to such issues, the inventors believe that a product that would be helpful in alleviating certain aspects of driver discomfort would be well-received if embodied in a way that is not only functional, but also appealing to the lifestyle and typical values of a professional truck driver, especially the great pride they take in their profession and the particular truck they drive.

The shoe that is the subject of this invention is believed to be such a product.

A survey of professional truckers has disclosed that a driver's shoes are quite important to his/her job. A significant number identified at least some degree of discomfort due to issues that included one or more of: foot sweat, athlete's foot, lower back ache, poor foot circulation, and ankle and shin soreness. The survey attributed a greater discomfort to issues involving foot sweat, tense foot muscles, and athlete's foot. A number of truckers noted what they considered a lack of useful, useable, and desirable products that could address those issues.

A percentage of truckers, suggested by the survey to be greater than 50% of the driver population, carry both work boots and tennis shoes in their truck, and a significant portion of them also carry slip-on shoes. Truckers have indicated that they drive in either tennis shoes or slip-on shoes due to comfort and convenience, but that they change the more comfortable footwear to less comfortable work boots when they have to get out of their trucks. Therefore, while a boot would be understood not to be a preferred driving shoe, it is nonetheless important to a long-haul trucker.

SUMMARY OF THE INVENTION

The present invention relates to a driving shoe that integrates the comfort of an athletic shoe and the outside environmental characteristics of a boot to provide shoe performance characteristics that would be desired by professional truck drivers.

The constructional elements of the shoe provide not only the desired functional attributes, but do so in a way that creates a highly distinctive appearance for relating the shoe to trucks and truck components manufactured by a related company of the present assignee.

Important functional attributes in a truck driving shoe include cushioning, weather resistance, ventilation, foot protection, arch support, and ease of putting on and taking off. A shoe's durability and its ability to alleviate problems such as those mentioned above are also important.

A general aspect of the invention relates to a shoe that comprises an upper assembly of components cooperating with a lower assembly of components to provide an interior for a person's foot and a foot opening through which a person's foot can be inserted into and removed from the shoe interior.

The lower assembly comprises an outer sole, a mid-sole overlying the outer sole on the interior, and an inner sole overlying the mid-sole on the interior.

The upper assembly comprises a toe cover for covering toes of a person's foot, with the toe cover comprising a through-opening to the shoe interior for venting the shoe interior to the exterior of the shoe and a vent cover operable from the exterior of the shoe for selectively covering and uncovering the through-opening.

An air exhaust system is disposed in a formation in the mid-sole for intaking air through aperture structure in the inner sole and forcing the intaken air to the exterior.

The specific disclosed preferred embodiment comprises two air pumps that interact with ventilation provided by the toe cover through-opening to exhaust stale air out of the shoe promoting cooling of the wearer's foot. Additional ventilation is provided by the mesh material around the ankle. The outsole is constructed to provide flexibility and promote comfort when the wearer is driving.

The foregoing, along with further features and advantages of the invention, will be seen in the following disclosure of a presently preferred embodiment of the invention depicting the best mode contemplated at this time for carrying out the invention. This specification includes drawings, now briefly described as follows.

DESCRIPTION OF THE PREFERRED EMBODIMENT

Figure 1:
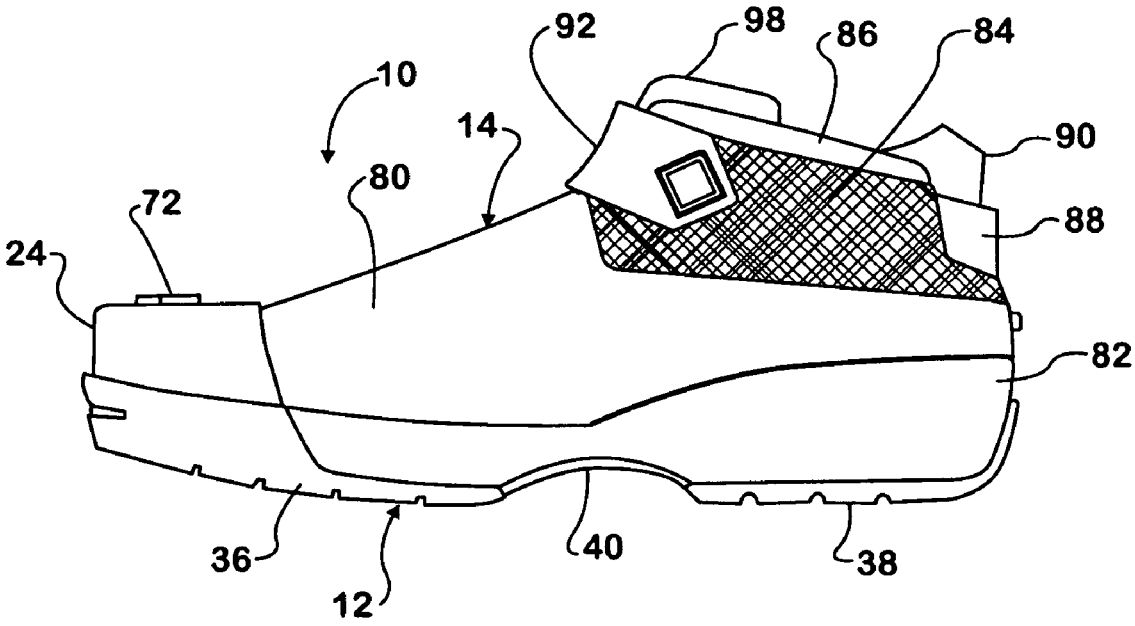
FIG. 1 is a left side elevation view of a left shoe of a pair of shoes that embody principles of the present invention.
Figure 2:
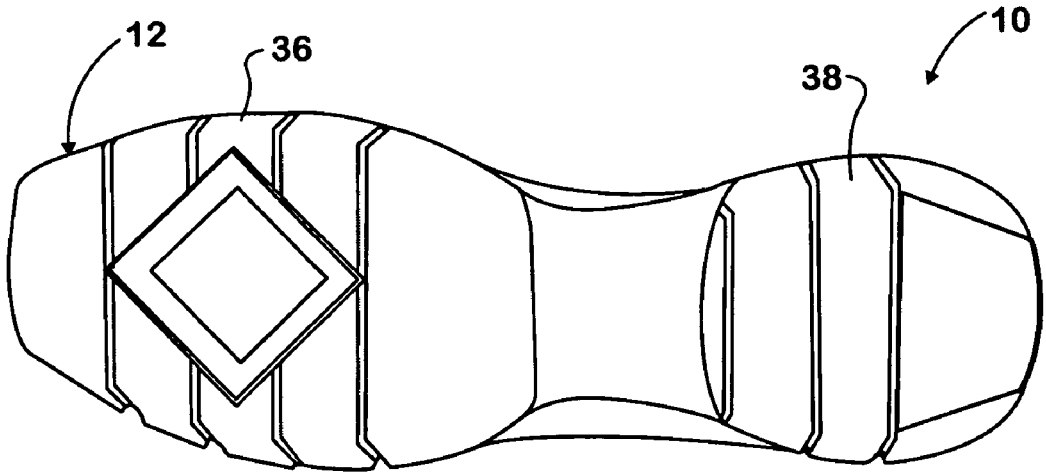
FIG. 2 is bottom view of the right shoe of the pair.
Figure 3:
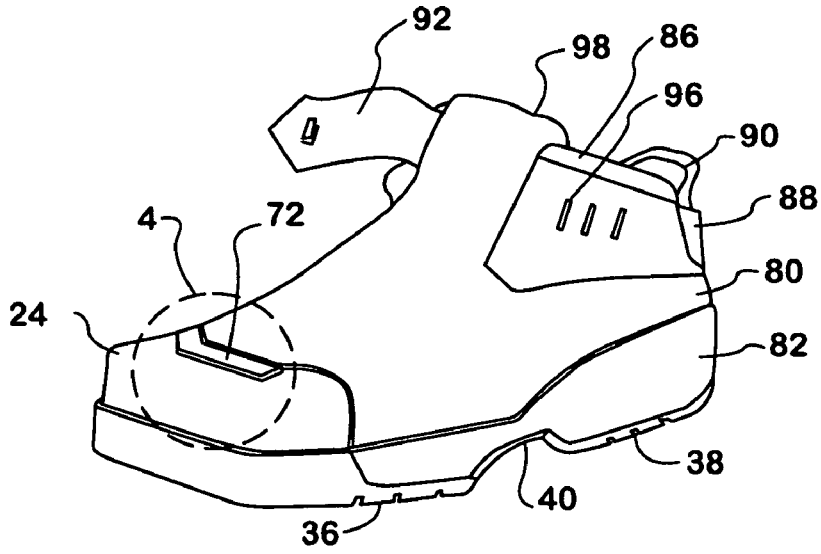
FIG. 3 is a perspective view of the left shoe with the strap unbuckled.

For illustrating principles of the invention, the drawings show a shoe 10 to comprise a lower assembly 12 and an upper assembly 14 that cooperate to provide an interior for a person's foot and a foot opening through which a person's foot can be inserted into and removed from the shoe interior. At the foot opening, the shoe has a height that is greater than that of a low-cut shoe thereby endowing the shoe with a general appearance somewhat like that of a shoe-boot.

Each assembly 12, 14 comprises a number of components. Lower assembly 12 comprises an outer sole 16, a mid-sole 18 overlying outer sole 16 on the interior of shoe 10, and an inner sole 20 overlying mid-sole 18. An air exhaust system 22 is captured between mid-sole 18 and inner sole 20.

Upper assembly 14 comprises a toe cover 24 for covering toes of a person's foot, and an upper 26 that is fabricated from a number of individual parts.

Outer sole 16 comprises a generally horizontally expansive body 28 contoured to conform generally to the sole of a person's foot, but with slightly larger length and width. The perimeter margin has a short wall 30 running along the sides between a taller toe wall 32 and a taller heel wall 34.

The bottom of outer sole 16 has front and rear treads 36, 38 respectively separated from each other by a bridge 40.

Air exhaust system 22 comprises a first pump 42, a first exhaust conduit 44 from an outlet of the pump, and an air inlet 46. The system also comprises a second pump 48, a second exhaust conduit 50 from an outlet of pump 48, and an air inlet 52 to pump 48.

Mid-sole 18 comprises a recess 54 and a channel 56 running from the recess to the rear of the mid-sole. The mid-sole also comprises a second recess 58 and a channel 60 running from the latter recess to the rear of the mid-sole. Each recess and channel are shaped to allow the respective pump 42, 48 to be placed in the respective recess and channel.

Pumps 42, 48 are vinyl bladder pumps, similar to those shown in U.S. Pat. Nos. 5,953,835; 5,996,250; and 6,463,679. They are relatively thin and flat, and when compressed in the direction of their thinness, exhaust a portion of a charge of air from their interior through the respective exhaust conduit 44, 50. In the center of the top face of each pump is a respective air intake through which air can enter the interior of the bladder.

Figure 6:
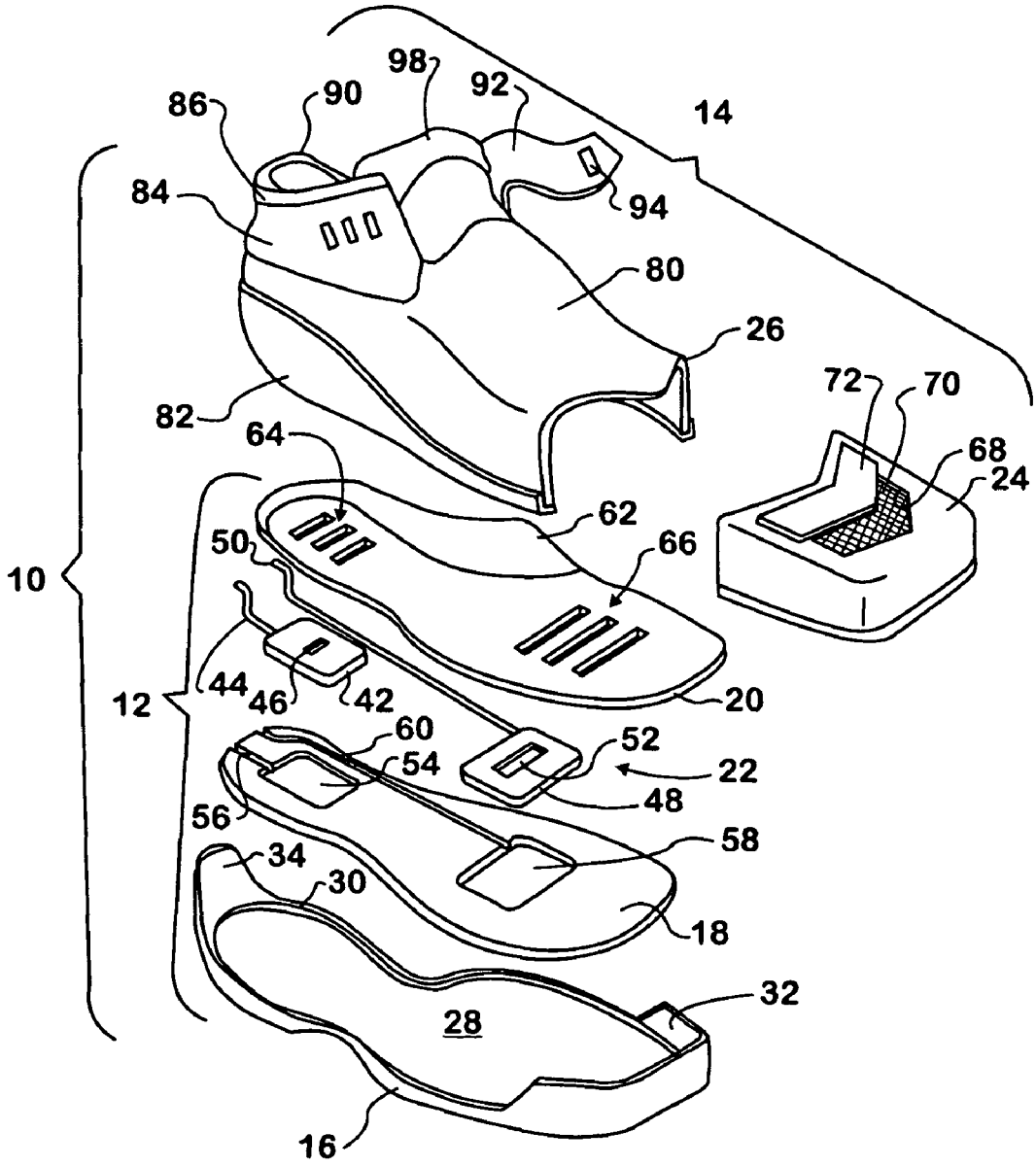
FIG. 6 is an exploded perspective view of components of the right shoe.
Figure 7:
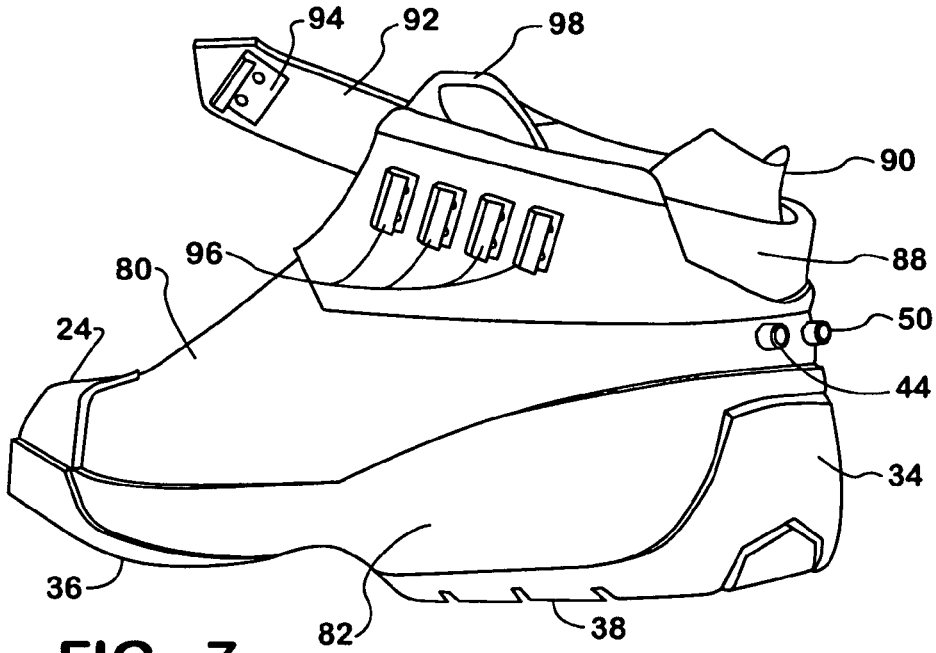
FIG. 7 is a perspective view of the left shoe with the strap unbuckled looking from the left rear.

Inner sole 20 provides comfortable cushioned support for the foot and comprises a shape for fitting with general conformance onto mid-sole 18. It includes an inclined wall 62, as shown in FIG. 6, that provides support of the arch in the direction of the body's medial plane. Inner sole 20 further comprises aperture structures 64, 66 located respectively to overlie pumps 42, 48 respectively. Each aperture structure is a series of parallel through-slots in the inner sole.

When a person forces his/her heel downward on inner sole 20, the force is transmitted through material of the inner sole at aperture structure 64 to the top face of pump 42. A portion of the material and/or the heel effectively seal off, or obstruct, air inlet 46 sufficiently that continued downward pressure of the heel compresses a charge of air that has entered the bladder, forcing at least some of that charge through exhaust conduit 44 to the exterior.

When the downward heel pressure on inner sole 20 is removed, the obstruction of air inlet 46 is sufficiently reduced to allow the bladder to intake air and in doing so expand upward so that a subsequent application of heel force will again cause the pump to exhaust air. A uni-directional valve in the exhaust conduit prevents air from entering the pump through the exhaust conduit.

In like manner, when a person forces the ball of his/her foot downward on inner sole 20, the force is transmitted through material of the inner sole at aperture structure 66 to the top face of pump 48. A portion of the material and/or the heel effectively seal off, or obstruct, air inlet 52 sufficiently that continued downward pressure of the foot's ball compresses a charge of air that has entered the bladder, forcing at least some of that charge through exhaust conduit 50 to the exterior.

When the downward pressure of the foot's ball on inner sole 20 is removed, the obstruction of air inlet 52 is sufficiently reduced to allow the bladder to intake air and in doing so expand upward so that a subsequent application of force will again cause the pump to exhaust air. A uni-directional valve in the exhaust conduit prevents air from entering the pump through the exhaust conduit.

Figure 8:
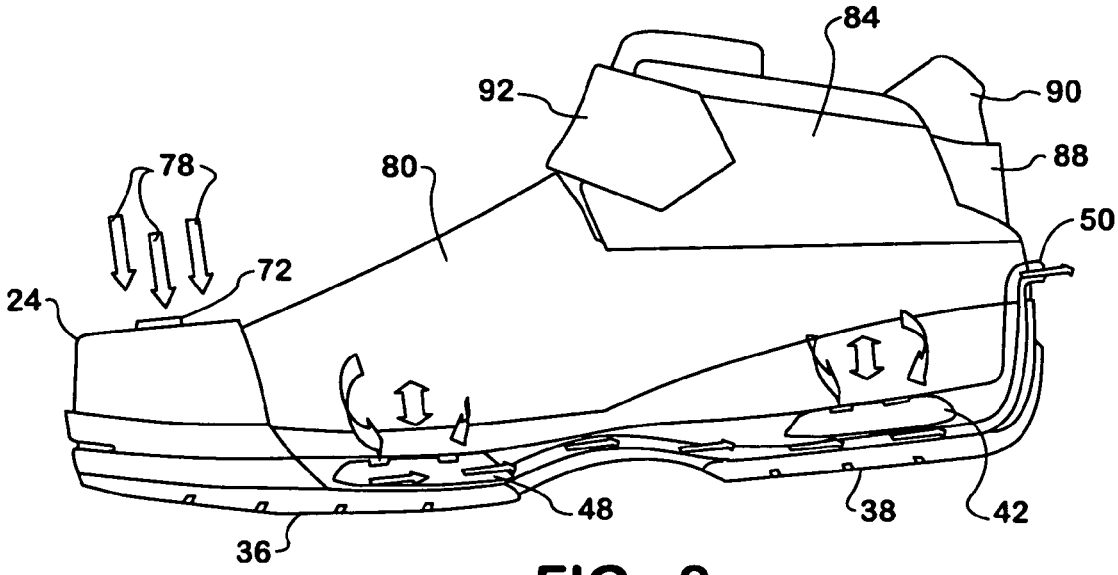
FIG. 8 is a left side elevation view of the shoe illustrating a functional aspect of the shoe.

The pumping action is pictorially presented in FIG. 8.

In the context of the shoe, the air that enters each pump is stale air from below the foot that has absorbed some small amount of heat from the foot. It is this air that is exhausted from the interior of the shoe at the rear of the heel.

As a person walks, a representative volumetric flow rate from each pump during each step is 0.89 $in^3$. Based on an average air layer thickness of 0.2 inches between the shoe and the foot, the pump can theoretically develop sufficient airflow to completely refresh the air in the shoe every 10.7 steps. The refreshing air enters the shoe interior in the following ways.

Figure 5:
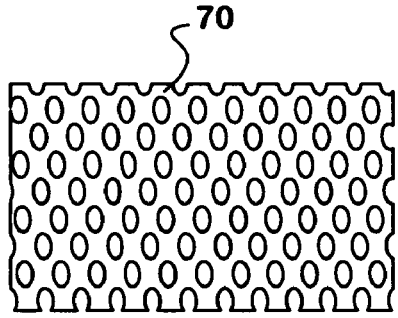
FIG. 5 is a plan view of a material used in portions of the shoe

Toe cover 24 comprises a hard body, an injection-molded plastic for example, for providing some degree of protection against dropped objects. A chevron-shaped through-opening 68 in the top wall of cover 24 contains a breathable fabric piece 70, such as a natural or synthetic mesh as shown in FIG. 5. A similarly shaped vent cover 72 can slide fore and aft to selectively cover and uncover through-opening 68. The ability of the vent cover to slide while being retained on the toe cover is provided by tongue and groove tracks 74 along the sides of the vent cover and through-opening.

Figure 4:
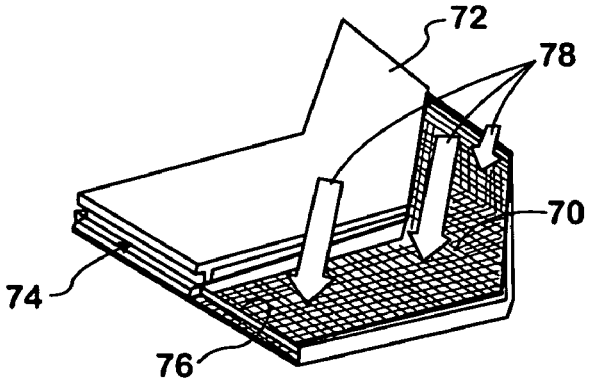
FIG. 4 is an enlarged fragmentary perspective view in circle 4 of FIG. 3 but looking from a different direction.

FIGS. 4 and 8 show the vent cover open so that air can enter the shoe interior through fabric piece 70 to cool the toes and proximal portion of the foot (arrows 78). When slid closed, the perimeter margin of vent cover 72 contacts a perimeter gasket 76 surrounding the through-opening for providing some degree of liquid-resistant sealing around the closed vent cover. The vent cover can be assembled to the toe cover by slightly flexing the former and fitting it to the through-opening so that the tongue and groove structures can come into proper sliding engagement when the flexing of the vent cover is relieved.

Although a chevron-shaped is shown for the vent cover and through-opening, general principles of the invention do not require that specific shape as long as they have some minimum area for ventilation, preferably not less than 0.75 $in^2$.

Upper 26 comprises a number of individual pieces assembled together. A piece 80 that covers instep, sides, and ankle of the foot is preferably fabricated from one or more pieces of leather. A four ounce weight (equivalent to $4/64^{th}$ inch thickness) of smooth grained leather, categorized as "Boot and Work" chap leather, is well-suited for this purpose. A piece 82 of rubber-type material is joined to the lower margin of piece 80 as shown, and it is via this piece 82 that the portion of upper assembly 14 rearward of toe cover 24 joins in sealed manner to the perimeter wall 30, 34 of outer sole 16.

⅛ inch thick neoprene rubber is a suitable material for piece 82. Outer sole 16 is preferably a 10 iron sole, which is equivalent to 5 mm thickness, and is constructed of Black SBR, a rubber compound that is both flexible and provides slip-resistance. With outer sole 16 being a rubber material, the use of piece 82 serves to in effect extend the height of the water-impervious characteristics of the lower assembly around the side of the shoe, particularly in the heel area. This is believed to be beneficial to a trucker in various work environments, such as when the trucker has to exit the cab in unfavorable conditions like mud, rain, and snow.

The tread of outer sole 16 contains a cross-cut pattern in which the cross-cuts are quite shallow and narrow. That prevents larger pieces of gravel and significant amounts of mud from being caught in the cross-cuts and brought into the truck. It also makes it easier for the driver to scrape mud, debris, etc. from the bottom of the sole. Because keeping his/her truck clean is important to truckers, they value shoes that minimize the amount of shoe-tracking into a truck. The thinness and flexibility of outer sole 16 make shoe 10 quite comfortable for driving, yet the height of piece 82, a height greater than the thickness of the outer sole, contributes to the outward appearance of the shoe being more like a thick-soled boot than a shoe, an appearance that is favored by many truckers. Hence, combination of the relatively thin outer sole and piece 82 endow shoe 10 with both form and function.

The sides and top of the front margin of piece 80 join to the sides and top of the rear margin of toe cover 24 in a sealed manner, and the bottom margin of the toe cover joins to the outer sole at wall 32 also in a sealed manner.

Upper 26 covers the ankle. The foot opening of the shoe is at the top of the ankle covering portion. A portion of upper 26 that partially encircles the ankle along the sides and back comprises a breathable fabric layer band 84 running lengthwise along sides and back to provide ventilation of the interior. A leather rim 86 covers the top edge of band 84 along the sides and for further structural support, a taller U-shaped piece 88 is assembled to band 84 at the rear of the ankle. A flexible U-shaped support piece 90 protrudes even further upward behind the ankle.

A strap 92 having a hook-type catch 94 at a free end has the opposite end attached to the portion of upper 26 that partially encircles the ankle, with the attachment being made to that portion of the upper to the inside of the ankle. That portion of the upper to the outside of the ankle contains a series of hook-type catches 96. The portion of the upper partially encircling the sides and rear of the ankle leaves an open frontal space that is filled by a tongue 98 extending from the portion of piece 80 that covers the instep.

With tongue 98 placed to complete encirclement of the ankle, strap 92 can be brought across the tongue and hooked with any appropriate one of the series of complementary hook-type catches 96 to provide the desired degree of tightening around the ankle. By magnetizing the hook-type catch 94 and making the series of complementary hook-type catches 96 ferromagnetic, accidental separation of connected hooks becomes less likely.

The use of both mesh band 84 around the ankle and the air exhaust system can contribute to a cooler drier environment inside the shoe, aiding in alleviating problems like those mentioned before. In the disclosed shoe these attributes are provided in conjunction with the professional look of a boot-type shoe. The same mesh is fabric mesh is used in the toe cover through-opening 68 to allow air flow while and preventing certain debris from entering the shoe when the vent cover is open. An 840×1680 Denier Nylon mesh fabric is an example of a suitable fabric. Tongue 98 can be solid leather, or alternately comprise breathable material such as this mesh fabric. FIG. 6 shows a band of mesh fabric in the tongue. With the tongue in place that band bridges the ends of band 84.

It is believed that the shoe that has been disclosed here is well suited to the life-style and routines of professional truck drivers. The shoe is suited for multiple environments, such as in driving and when walking outside in wet and possibly muddy conditions. Because time is important to truckers, they would be expected not to want to have to waste it fumbling with and/or changing shoes. The toe cover vent can be easily opened and closed. Attachment and release of the strap is also quick. The shoe combines aesthetics, function, and durability, all attributes that are expected to be appreciated by truckers.

During driving, a trucker's foot may exert pressure on the small areas at the edge of the heel due to the angle of the foot while on the gas pedal. To dissipate this pressure, the heel of the shoe is contoured and reinforced with rubber as has been described. The outer sole material is flexible and the rear of the ankle enjoys flexible ankle support, as described, to enhance driving comfort.

The shoe is believed to provide a comprehensive footwear solution for a truck driver who demands a high level of comfort and convenience in many environments and conditions. While the shoe has been created with driving needs in mind, it is considered an excellent walking shoe. By actively circulating air and providing adequate passive ventilation, a driver's feet can remain cooler during extended hours of driving. In wet conditions, the shoe is easily set to water-resistant mode by closing the vent cover in the toe which prevents rain or water (up to two inches deep) from entering. The air exhaust system functions inherently with foot movement and is unobtrusive to the comfort and ergonomics of the shoe.

While a presently preferred embodiment of the invention has been illustrated and described, it should be appreciated that principles of the invention apply to all embodiments falling within the scope of the invention that is defined as follows.

What is claimed is:

1. A shoe comprising:

an upper assembly of components and a lower assembly of components cooperating to provide an interior for a person's foot and a foot opening through which a person's foot can be inserted from an exterior into the interior and removed from the interior to the exterior;

the lower assembly of components comprising an outer sole, a mid-sole overlying the outer sole on the interior, and an inner sole overlying the mid-sole on the interior, the inner sole comprising parallel slots extending through the inner sole;

the upper assembly of components comprising a hard toe cover for covering toes of a person's foot, the hard toe cover comprising a through-opening to the interior for venting the interior to the exterior and a vent cover operable from the exterior for selectively covering and uncovering the through-opening;

the outer sole comprising a bottom surface having a first zone comprising a rear tread for underlying the heel of a person's foot, a second zone comprising a front tread for underlying the ball of a person's foot, and a bridge that causes a portion of the bottom surface underlying the arch of a person's foot to be spaced from a flat horizontal surface when the shoe is resting with the two treads on that surface, and an air exhaust system disposed in a formation in the mid-sole and comprising a first bladder pump disposed between a first group of the parallel slots and the first zone and a second bladder pump disposed between a second group of the parallel slots and the second zone, the first bladder pump having an air inlet open to the interior beneath the first group of the parallel slots, the second bladder pump having an air inlet open to the interior beneath the second group of the parallel slots, a first exhaust conduit from the first bladder pump to the exterior, and a second exhaust conduit from the second bladder pump to the exterior, and wherein when downward pressure is applied to the inner sole by the ball of a person's foot, the air inlet of the second bladder pump is effectively sealed off to compress a charge of air that has entered through the second group of the parallel slots and force at least some of that charge through the second exhaust conduit to the exterior, and when downward pressure is applied to the inner sole by the heel of a person's foot, the air inlet of the first bladder pump is effectively sealed off to compress a charge of air that has entered through the first group of the parallel slots and force at least some of that charge through the first exhaust conduit to the exterior.

2. The shoe as set forth in claim 1 wherein the hard toe cover comprises a top wall containing the through-opening, and the vent cover is arranged for reciprocal fore-and-aft sliding on the top wall for selectively covering and uncovering the through-opening.

3. The shoe as set forth in claim 2 including a breathable fabric layer covering the through-opening in underlying relation to the vent cover.

4. The shoe as set forth in claim 1 wherein a portion of the upper assembly of components partially encircles the foot opening and comprises a breathable fabric layer band also partially encircling the foot opening for venting the interior to the exterior.

5. The shoe as set forth in claim 4 wherein the outer sole comprises a toe end, a heel end, and sides extending between the toe end and the heel end, and the upper assembly of components comprises at least one leather piece constructed and arranged to have a lower margin joining a margin of the outer sole that extends from the hard toe cover along one of the sides of the outer sole toward the heel end of the outer sole, around the heel end of the outer sole, and back to the hard toe cover along the other side of the outer sole, the at least one leather piece being further constructed and arranged to cover sides and heel of a person's foot below the breathable fabric layer band and to also cover the instep of a person's foot.

6. The shoe as set forth in claim 5 further including a tongue extending from the portion of the at least one leather piece covering the instep of a person's foot and cooperating with the portion of the upper assembly of components partially encircling the foot opening for completing encirclement of a person's foot around the ankle.

7. The shoe as set forth in claim 6 further including a strap having one end joined to the portion of the upper assembly of components that partially encircles the foot opening, the one end of the strap being disposed to one side of the tongue, and the strap having a length sufficient to extend across the tongue to an opposite end for separably attaching the latter end to the portion of the upper assembly that partially encircles the foot opening on the opposite side of the tongue.

8. The shoe as set forth in claim 7 wherein the opposite end of the strap comprises a hook-type catch and the portion of the upper assembly of components to which the opposite end of the strap separably attaches comprises a series of complementary hook-type catches, with any one of which the catch on the strap can hook to make the attachment.

9. The shoe as set forth in claim 7 wherein the hook-type catch on the strap is magnetized and the series of complementary hook-type catches are ferromagnetic.

* * * * *